US006182944B1

(12) United States Patent
Veronese et al.

(10) Patent No.: US 6,182,944 B1
(45) Date of Patent: Feb. 6, 2001

(54) SYSTEM FOR CONNECTING VALVE UNITS FOR GAS WATER-HEATERS TO TANKS BELONGING TO THE WATER-HEATERS

(75) Inventors: Ciuceppe Veronese, Montegrotto Terme; Alessandro Toniolo; Antonio Sardena, both of Padua, all of (IT)

(73) Assignee: Sit La Precisa, S.p.A., Padua (IT)

( * ) Notice: Under 35 U.S.C. 154(b), the term of this patent shall be extended for 0 days.

(21) Appl. No.: 09/275,877

(22) Filed: Mar. 25, 1999

(30) Foreign Application Priority Data

Dec. 4, 1998 (IT) ..... PD98A0283

(51) Int. Cl.[7] ..... F16K 51/00; F16K 49/00; F16L 37/00

(52) U.S. Cl. ..... 251/144; 251/143; 137/335; 285/305

(58) Field of Search ..... 285/305; 251/144, 251/143; 137/335

(56) References Cited

U.S. PATENT DOCUMENTS 4,817,564 * 4/1989 Akkala et al. ..... 122/17
5,261,438 * 11/1993 Katchka ..... 137/15
5,348,037 * 9/1994 Katchka ..... 137/15
5,419,356 * 5/1995 Katchka ..... 137/15
5,607,192 * 3/1997 Lee ..... 285/305
5,620,016 * 4/1997 Katchka ..... 137/15
5,941,200 * 8/1999 Boros et al. ..... 122/13.1

FOREIGN PATENT DOCUMENTS

593937A1 * 9/1993 (JP) ..... 285/305

* cited by examiner

*Primary Examiner*—Kevin Shaver
*Assistant Examiner*—David A. Bonderer
(74) *Attorney, Agent, or Firm*—Sughrue, Mion, Zinn, Macpeak & Seas, PLLC

(57) ABSTRACT

In the system described for connecting a valve unit for gas water-heaters to a tank of the water-heater, a probe belonging to the valve unit is housed in the tank in a leaktight manner. The system comprises a first element belonging to the valve unit and/or fixed thereto, a second element which projects from the tank and can be housed in a seat of the first element, the second element constituting a support and/or cover for the probe and having an outer surface in which there is a transverse groove, and a third element which is restrained axially on the first element and at least a portion of which extends in the seat in an arrangement such as to engage the groove when the second element is housed in the seat so as to clamp the first and second elements to one another axially, the third element being resiliently deformable between a first position in which the said portion projects into the seat and a second position in which the said portion is outside the seat in order to release the groove.

4 Claims, 3 Drawing Sheets

SYSTEM FOR CONNECTING VALVE UNITS FOR GAS WATER-HEATERS TO TANKS BELONGING TO THE WATER-HEATERS

BACKGROUND OF THE INVENTION

The present invention relates to a system for connecting valve units for gas water-heaters to tanks belonging to the water-heaters.

In the specific technical field of the present invention, there is a need to connect gas-valve units to tanks of the type generally used in water-heaters for domestic heating. Typically, in these applications, the tank has a hole into which a tubular body is screwed in a leaktight manner; a regulation probe, for example, a thermostatic bulb, extends through the tubular body and is supported thereby and housed inside the tank. Means are provided on the tubular body and on the valve unit for clamping the valve unit and the tank to one another axially.

A connection system of the type indicated is known from U.S. Pat. No. 5,261,438. The system described therein provides for the valve unit to be clamped axially by means of a spring ring which is mounted externally on a shank projecting from the valve unit and which can engage an annular groove formed inside the tubular body screwed into the tank. The insertion of the shank into the tubular body from the front causes the resilient ring to be engaged in the groove, connecting the valve unit axially to the tank.

One of the problems encountered in this system is that the coupling between the valve unit and the tubular body is irreversible and, once the valve unit is connected to the tank, it can be disconnected only by completely unscrewing the tubular body. This operation therefore renders maintenance operations on the apparatus with which the valve unit is associated rather complex.

This system also involves a fairly complex structure as well as a valve unit which is fairly bulky axially, mainly because of the projecting shank provided for the mounting of the clamping spring ring.

SUMMARY OF THE INVENTION

The technical problem upon which the present invention is based is that of providing a connection system for valve units for gas water-heaters which is designed structurally and functionally so as to prevent all of the problems complained of with reference to the prior art mentioned.

This problem is solved by the invention by a connection system formed in accordance with the following claims.

BRIEF DESCRIPTION OF THE DRAWING

The characteristics and the advantages of the invention will become clearer from the detailed description of a preferred embodiment thereof, described by way of non-limiting example with reference to the appended drawings, in which.

DETAILED DESCRIPTION OF THE INVENTION

Figure 1:
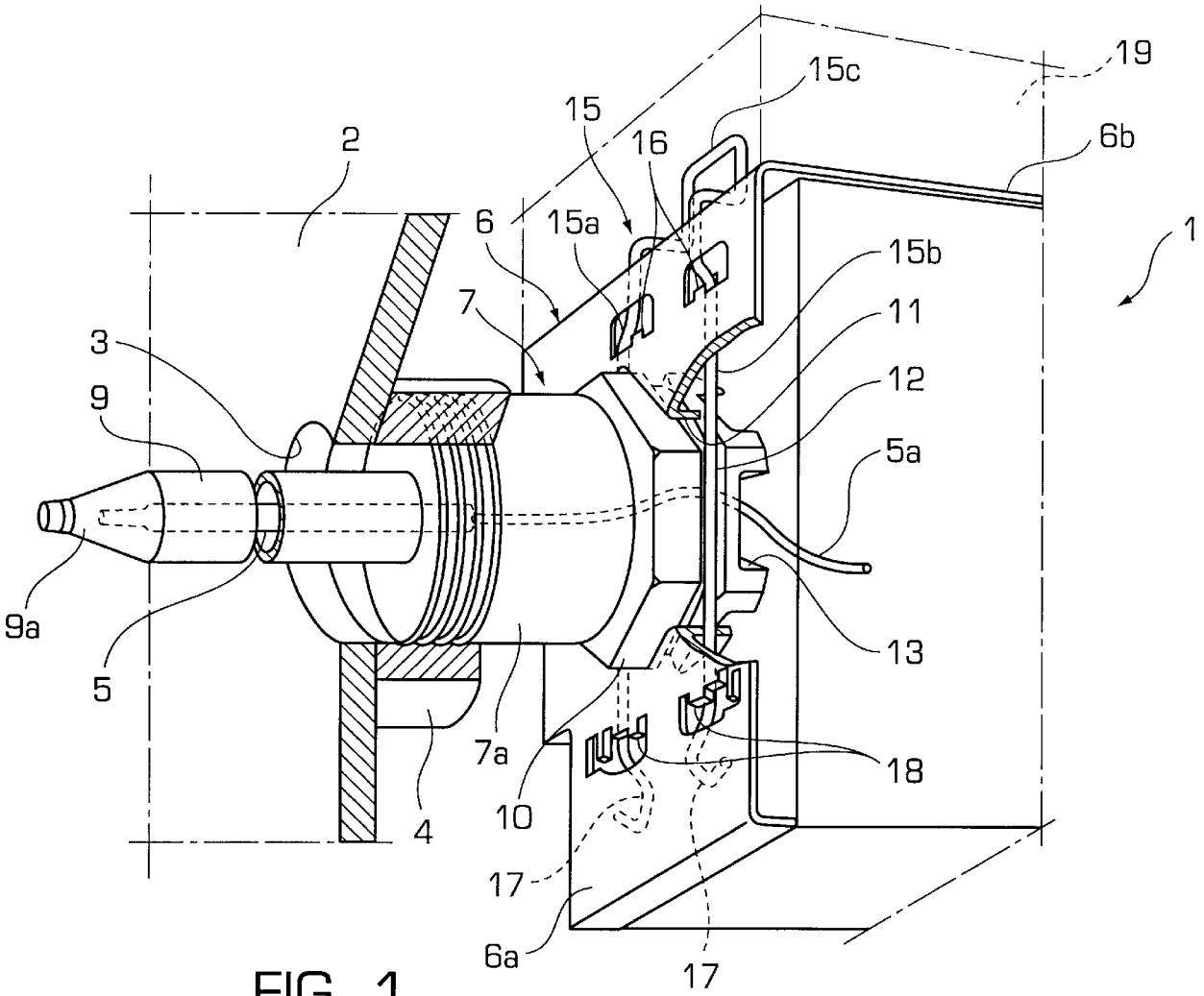
FIG. 1 is a partially-sectioned, perspective view of a system according to the invention for connecting a valve unit to a tank.

With reference to the drawings mentioned, a valve unit, generally indicated 1, is arranged for mounting on a tank 2, shown only partially, by a connection system formed in accordance with the present invention. The invention is intended for use particularly but not exclusively for connecting valve units for gas water-heaters to tanks associated with the said water-heaters.

The tank 2 has a through-hole 3 in the region of which an internally-threaded connector 4 is fixed to the outer surface of the tank. A regulation probe 5 connected to the valve unit by means of a connection cable 5*a* is housed in the tank, through the hole 3.

The connection system comprises a first element and a second element, indicated 6 and 7, respectively. The first element comprises a plate-shaped element 6*a* fixed to the valve unit 1 and the second element comprises a tubular body 7*a* projecting from the tank.

The plate-shaped element 6*a* preferably has a portion 6*b* for attachment to the valve unit by means of screws or similar fixing means.

The tubular body 7*a* is screwed into the connector 4 in a leaktight manner and has an axial through-hole 8. The hole 8 defines, starting from the end which is screwed into the connector 4, first and second adjacent cylindrical portions, the second portion having a smaller diameter than the first, and a third, conical portion, the diameter of which increases towards the opposite end of the body 7*a*. A blind tubular element 9 extending coaxially with the body 7*a* has its open end fixed in a leaktight manner in the second portion and is closed at its opposite end by a base 9*a*. The tubular element 9 is preferably fixed to the body 7*a* by being glued to the corresponding cylindrical internal portion of the body 7*a* in a manner such as to ensure a fluid-tight seal. The tubular element 9 constitutes a support and/or cover for the probe 5. It will be noted that, by virtue of the fluid-tight seal ensured between the tubular element 9 and the body 7*a*, leakage of liquid from the tank 2 through the hole 3 is prevented and the probe 5 is housed inside the tank without direct contact with the liquid contained therein.

The body 7*a* of the second element 7 has, at the opposite end to the portion which is screwed into the connector 4, a head 10 which can be housed in a seat 11 formed in the plate-shaped element 6*a*. The head 10 and the seat 11 have respective mating polygonal profiles so as to prevent relative rotation between the body 7*a* and the plate-shaped element 6*a*.

The head 10 also has a transverse groove 12 in its outer surface. Moreover, the head has holes and/or slots, all indicated 13, through which capillaries for connecting the probe 5 to the valve unit 1 can extend. An end chamfer which is provided on the head 10 and the function of which will be explained in detail in the following description, is indicated 14.

The connection system also comprises a third element which is restrained axially on the plate-shaped element 6*a* of the valve unit and which can engage the groove 12, as will be explained below. The third element comprises a clip 15 mounted for sliding on the plate-shaped element 6*a*. The clip is substantially U-shaped with two opposed arms 15*a*, 15*b* which can be opened out resiliently and are connected by a connecting region 15*c* constituting an operating appendage for the clip during its movement along an axis transverse the axis of the coupling of the valve unit to the tank. At least a portion of each arm 15*a*, 15*b* extends in the seat 11 in an arrangement such that, when the head is housed in the seat, the arms clasp two opposite sides of the head 10 between them and engage the groove 12, consequently clamping the body 7*a* and the plate-shaped element 6*a* to one another axially. The arms 15*a*, 15*b* are resiliently deformable between a first position in which the said portions project into the seat (FIG. 2) and a second position in which the said portions are outside the seat in order to release the groove 12.

The arms 15*a*, 15*b* are mounted for sliding on the plate-shaped element 6*a* by means of supports, preferably formed by bending of corresponding portions of the plate-shaped element, all indicated 16.

The clip 15 is preferably made of harmonic steel wire. The free end of each arm 15*a*, 15*b* is bent to form a projection 17 which can interfere with a respective abutment 18 of the plate-shaped element 6*a* during the sliding of the clip so as to be opened out from the first position to the second as a result of a movement along the transverse axis.

Figure 2:
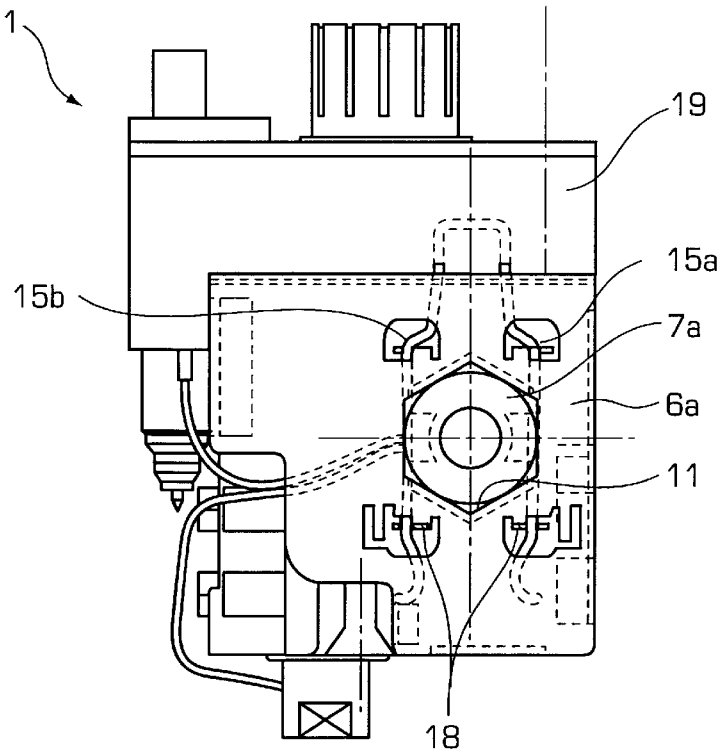
FIG. 2 is a front elevational view of the valve unit of FIG. 1 in a first operative position.
Figure 5:
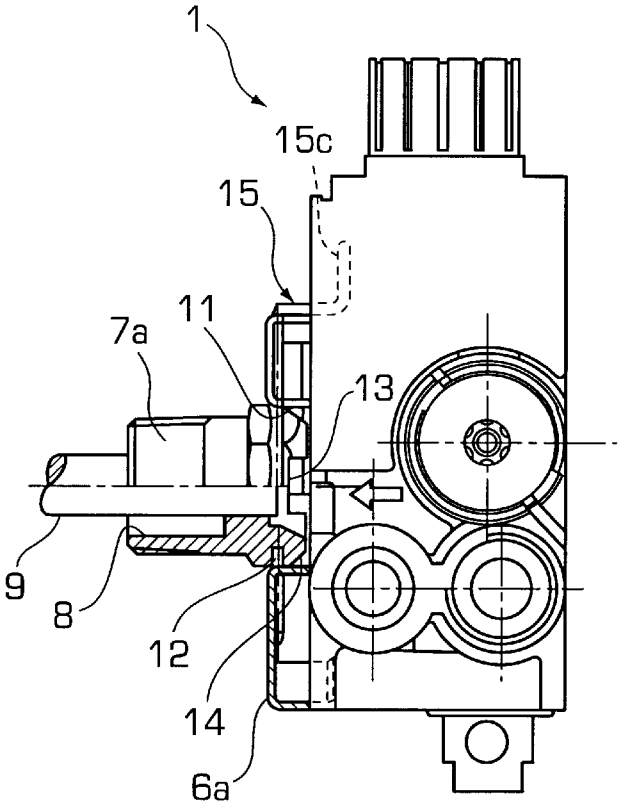
FIGS. 4 and 5 are partial sections showing the valve unit of the previous drawings from below and in side elevation, respectively.
Figure 4:
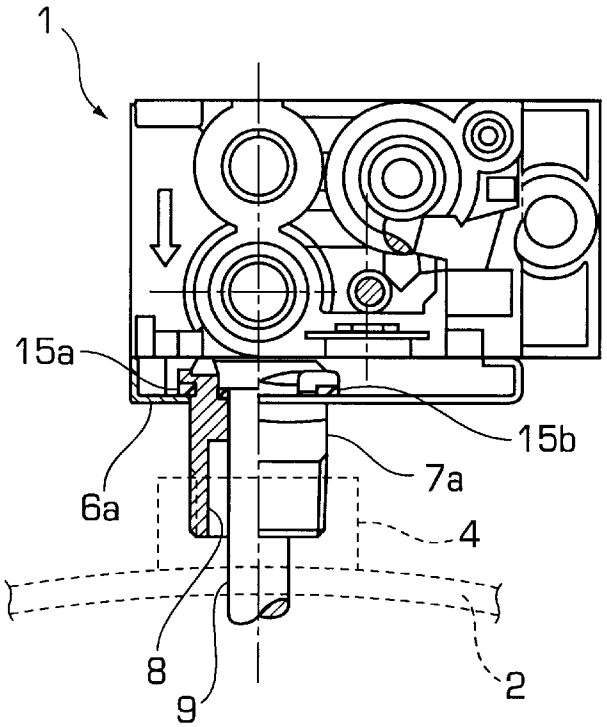

The connection system of the invention provides for the head 10 of the body 7*a* to be urged axially into the seat 11 of the valve unit, starting with the clip in the first position of (FIG. 2). The insertion of the head causes the arms 15*a*, 15*b* of the clip to open out resiliently and subsequently to engage in the groove 12 with a snap coupling which restrains the body 7*a* axially relative to the plate-shaped element 6*a*. The opening-out of the clip is facilitated by the end chamfer 14 provided on the head 10.

Figure 3:
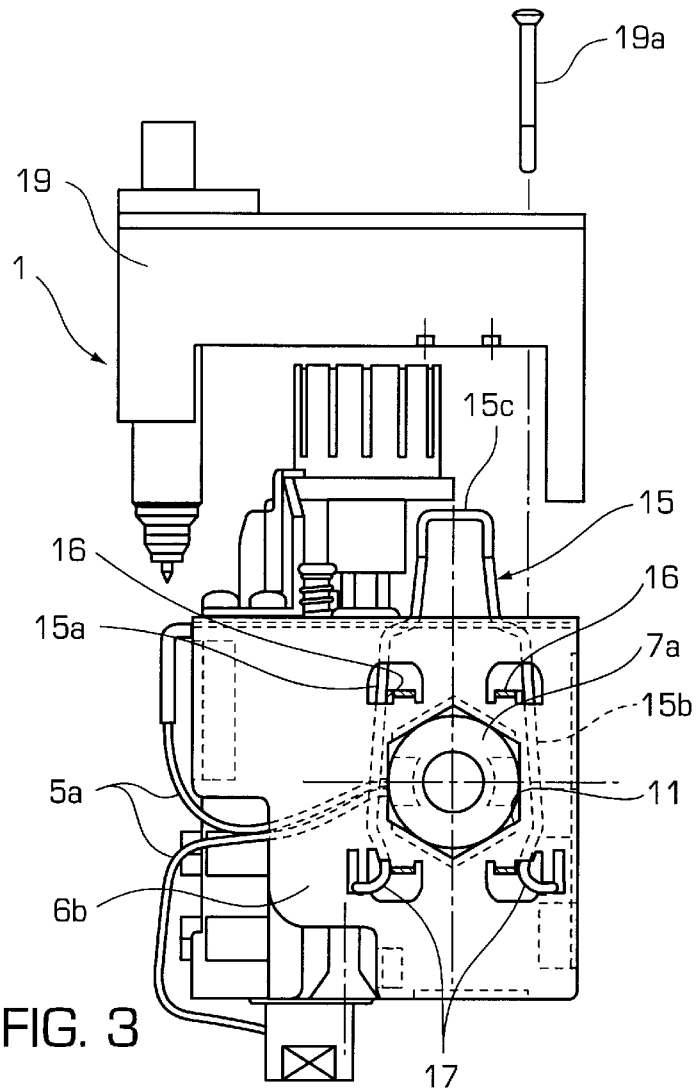
FIG. 3 is a view corresponding to that of FIG. 2 with the valve unit in a second operative position.

In order to disconnect the valve unit 1 from the tank, the clip 15 is moved transversely relative to the axial coupling axis, by means of the operating appendage 15*c*, until the clip 15 reaches the second position of FIG. 3 in which the arms 15*a*, 15*b* are opened out resiliently by virtue of the interference of the projections 17 with the abutments 18 so as to release the groove 12 and allow the body 7*a* to be removed from the seat 11, consequently disconnecting the valve unit from the tank. The operating appendage 15*c* is housed inside a cover element 19 fixed to the valve unit by screws 19*a*. As a result, access to the appendage 15*c* in order to disconnect the valve unit from the tank is possible only after intentional removal of the cover 19, thus avoiding the danger of accidental and unintentional disconnection of the valve unit.

The invention thus solves the problem set, achieving many advantages. Amongst these is the relative structural simplicity of the axial clamping means provided on the tubular body fixed to the tank and on the valve unit. Moreover, the connection system is releasable and enables the valve unit to be disconnected quickly and easily from the tank. Not the least important advantage is the axial compactness of the valve unit in comparison with known solutions.

What is claimed is:

1. A system for connecting a valve unit for gas water-heaters to a tank of the water-heater, in which a probe belonging to the valve unit is housed in the tank in a leaktight manner, comprising:

a first element adapted to be secured to the valve unit, a second element adapted to be secured to and project outwardly from the tank and be housed in a seat of the first element, the second element having at one end a cover for the probe and having adjacent an opposite end an outer surface in which there is a transverse groove, a third element which is mounted on the first element for movement transversely of the second element and at least a portion of which extends in the seat in an arrangement such as to detachably engage the groove when the second element is housed in the seat so as to clamp the first and second elements to one another axially, the third element being resiliently deformable between a first position in which the said portion projects into the seat and a second position in which the said portion is outside the seat in order to release the groove, wherein the second element has a tubular body having, at said one end coupling means for coupling with a connector of the tank, and having at said opposite end, a head which can be housed at least partially in the seat and in which the groove is formed, wherein the third element comprises a clip which can clasp two opposite sides of the head between its arms, and further wherein the head has an end chamfer for moving the arms of the clip apart during its insertion in the seat.

2. A system for connecting a valve unit for gas water-heaters to a tank of the water-heater, in which a probe belonging to the valve unit is housed in the tank in a leaktight manner, comprising:

a first element adapted to be secured to the valve unit, a second element adapted to be secured to and project outwardly from the tank and be housed in a seat of the first element, the second element having at one end a cover for the probe and having adjacent an opposite end an outer surface in which there is a transverse groove, a third element which is mounted on the first element for movement transversely of the second element and at least a portion of which extends in the seat in an arrangement such as to detachably engage the groove when the second element is housed in the seat so as to clamp the first and second elements to one another axially, the third element being resiliently deformable between a first position in which the said portion projects into the seat and a second position in which the said portion is outside the seat in order to release the groove, wherein the second element has a tubular body having, at said one end coupling means for coupling with a connector of the tank, and having at said opposite end, a head which can be housed at least partially in the seat and in which the groove is formed, and further wherein the head has openings for the passage of capillaries for connecting the probe to the valve unit.

3. A system for connecting a valve unit for gas water-heaters to a tank of the water-heater, in which a probe belonging to the valve unit is housed in the tank in a leaktight manner, comprising:

a first element adapted to be secured to the valve unit, a second element adapted to be secured to and project outwardly from the tank and be housed in a seat of the first element, the second element having at one end a cover for the probe and having adjacent an opposite end an outer surface in which there is a transverse groove, a third element which is mounted on the first element for movement transversely of the second element and at least a portion of which extends in the seat in an arrangement such as to detachably engage the groove when the second element is housed in the seat so as to clamp the first and second elements to one another axially, the third element being resiliently deformable between a first position in which the said portion projects into the seat and a second position in which the said portion is outside the seat in order to release the groove, wherein the second element comprises a blind tubular element for protecting the probe.

4. A system for connecting a valve unit for gas water-heaters to a tank of the water-heater, in which a probe belonging to the valve unit is housed in the tank in a leaktight manner, comprising:

a first element adapted to be secured to the valve unit, a second element adapted to be secured to and project outwardly from the tank and be housed in a seat of the first element, the second element having at one end a cover for the probe and having adjacent an opposite end an outer surface in which there is a transverse groove, a third element which is mounted on the first element for movement transversely of the second element and at least a portion of which extends in the seat in an arrangement such as to detachably engage the groove when the second element is housed in the seat so as to clamp the first and second elements to one another axially, the third element being resiliently deformable between a first position in which the said portion projects into the seat and a second position in which the said portion is outside the seat in order to release the groove, wherein the first element comprises a plate-shaped element adapted to be fixed to the valve unit, the plate-shaped element having support means for the slidable mounting of the clip.

* * * * *